United States Patent [19]

Keech

[11] Patent Number: 5,040,274

[45] Date of Patent: Aug. 20, 1991

[54] FASTENER FOR FOOTWEAR

[75] Inventor: Brian Keech, Northants, England

[73] Assignee: Haynes & Cann Limited, Northampton, England

[21] Appl. No.: 516,702

[22] Filed: Apr. 30, 1990

[30] Foreign Application Priority Data

May 10, 1989 [GB] United Kingdom ..... 8910691

[51] Int. Cl.[5] ..... A44B 19/00

[52] U.S. Cl. ..... 24/381; 24/390; 24/713.6

[58] Field of Search ..... 24/381, 382, 390, 306, 24/442, 713.3, 713.4, 713.6, 715.4

[56] References Cited

U.S. PATENT DOCUMENTS

| | | | |
|---|---|---|---|
| D. 270,779 | 10/1983 | Steinberg | 24/306 |
| 504,037 | 8/1893 | Judson | 24/390 |
| 557,208 | 3/1896 | Judson | 24/390 |
| 1,526,690 | 2/1925 | Anderson | 24/713.6 |
| 1,603,144 | 10/1926 | Nichols | 24/381 |
| 2,012,755 | 8/1935 | De Muth | 24/381 |
| 2,867,878 | 1/1959 | Sundback | 24/390 |
| 3,106,790 | 10/1963 | Zimmon | 24/442 |
| 3,112,545 | 12/1963 | Williams | 24/390 |
| 4,291,439 | 9/1981 | Riti | 24/306 |

FOREIGN PATENT DOCUMENTS

| | | | |
|---|---|---|---|
| 0129917 | 1/1985 | European Pat. Off. | 24/713.6 |
| 685831 | 12/1939 | Fed. Rep. of Germany | 24/381 |
| 3402 | of 1905 | United Kingdom | 24/713.6 |
| 447616 | 5/1936 | United Kingdom | 24/381 |

*Primary Examiner*—Victor N. Sakran

*Attorney, Agent, or Firm*—Scrivener and Clarke

[57] ABSTRACT

A removable lace-in fastener for an item of footwear comprises fastener means such as a sliding clasp fastener, openable and closeable along a longitudinally extending line and a pair of bendable, longitudinally extending strips of plastics material. Each strip has a plurality of integrally moulded eyelets provided along a first outer longitudinal edge thereof. Each strip is attached along a second longitudinal edge thereof to a free outer edge of the fastener means. The fastener may be attached into a boot or other item of footwear by lacing connecting some of the eyelets with conventional eyelets in the boot.

8 Claims, 1 Drawing Sheet

FASTENER FOR FOOTWEAR

This invention relates to a fastener for footwear, and particularly, but not exclusively, to the provision of an improved removable lace-in sliding clasp fastener such as for a military type boot.

The need for provision of a removable sliding clasp fastener for use with standard issue military boots and a design for such a fastener is well known. Whereas the standard issue lace-up boot gives optimum security of fit, it was recognised that the length of time taken to fit and lace up such a boot was a severe handicap to the responsiveness of the emergency services and air-crew.

A sliding clasp fastener is an alternative means for fastening boots but suffers from certain disadvantages. The fit of the boot is not so good as with a laced up boot, at least for many wearers. Also a sliding clasp fastener is prone to separation or failure when one or more teeth break, when the teeth mismesh, when the side tape fails or when the slide jams. If this happens usually the only remedy is complete replacement of the fastener. When it is fixed in place in a boot, it is difficult to remove and replace.

One design of sliding clasp fastener which was adopted to overcome these problems made use of a leather panel to which the sliding clasp fastener was mounted. Eyelets are positioned in the panel to either side of the fasteners so as to correspond to the existing eyelets of the eyelet flaps of the lace-up boot. The fastener panel could thus be laced into place on the boot, either above or beneath the facings (eyelet flaps) of the boot, preferably using the dutch lacing technique in order not to obstruct use of the fastener. One advantage of this mounting arrangement is that the fastener panel may be removed if the sliding clasp fastener should fail, allowing the boot to then be laced up in the conventional manner. It also allows the panel to be laced in with a degree of adjustment possible, thereby allowing a better fit of the boot.

However, the sliding clasp fastener must still be sewn to the leather panel, and eyelet holes provided in the leather. These may be time consuming operations, since the eyelets are generally spaced to correspond to the boot eyelets and these are not always regularly spaced.

It is an object of the present invention to provide a sliding clasp fastener panel for lacing into a boot or shoe and which allows savings in production time and cost of materials.

According to the present invention there is provided a removable lace-in fastener for an item of footwear comprising: fastener means openable and closeable along a longitudinally extending line, a pair of bendable, longitudinally extending strips of plastics material, each one of said pair having a plurality of integrally moulded eyelet means provided along a first longitudinal edge thereof and being attached along a second longitudinal edge thereof to a free outer edge of the fastener means, such that one of said pair of strips is located on each side of the fastener means.

Preferably the fastener means is a sliding clasp fastener.

Alternatively the fastener means may be a touch and close type fastener, e.g. as sold under the name Velcro.

The second longitudinal edge of each of said pair of strips may be serrated or otherwise provided with portions of reduced transverse thickness to increase flexibility of the strip.

The eyelet means may be substantially semi-annular extensions from the first edge of the strip and may be spaced regularly along its length.

An embodiment of the present invention will now be more particularly described by way of example and with reference to the accompanying drawings, in which.

Figure 1:
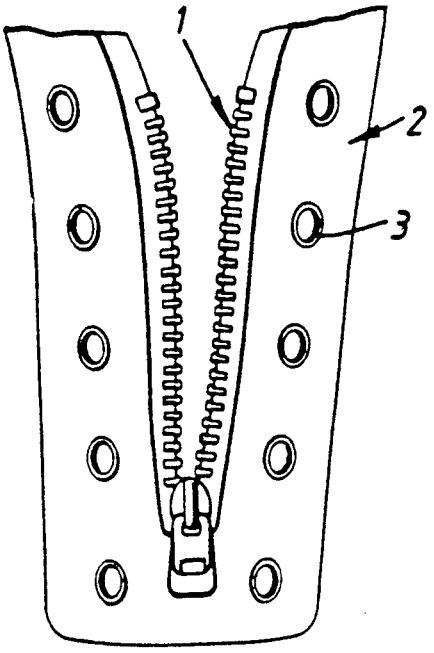
Fig.1. PRIOR ART
FIG. 1 is a front elevation of a lace-in fastener of the prior art.

The prior art lace-in sliding clasp fastener illustrated in FIG. 1 comprises a conventional sliding clasp fastener 1 fixed to a flexible reinforcement leather backing panel 2. Eyelets 3 are fitted through the panel 2 so as to rivet the backing material of the fastener 1 to the leather panel 2. The eyelets 3 are positioned so as to lie either side of the fastener and correspond to the existing eyelets on eyelet flaps of a boot for which the lace-in fastener is intended.

Figure 2:
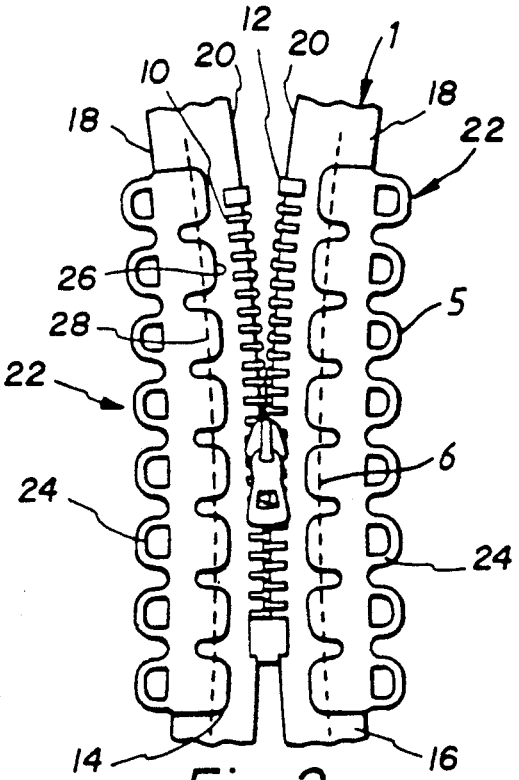
FIG. 2 is a front elevation of a lace-in fastener embodying the present invention.

In a lace-in fastener embodying the present invention, as illustrated in FIG. 2, the sliding clasp fastener comprises a pair of interengagable cooperating fastening elements 10, 12, which may be zipper elements as shown or could be any other type such as Velcro. Each fastening element is mounted on a longitudinal flexible backing panel 14, 16 each having a free outer edge 18 and an inner edge 20, the latter defining a longitudinally extending line along which the elements 10, 12 are movable between open and closed conditions. A pair of bendable longitudinally extending strips of plastics material 22, each having a plurality of eyelet rings 24, integrally moulded along their outer edges are attached by attachment projections 26 along their inner edges 28 to the free outer edges 18 of the backing panels 14, 16 with the eyelet rings extending in a direction away from the inner edges of the respective backing panels.

As can be seen, the prior art lace-in fastener of FIG. 1 has eyelets 3 spaced apart to match the spacing of existing eyelets on the lace flap of a boot. In accordance with the invention and as can be seen in FIG. 2, the eyelet rings 5 are more closely spaced than existing boot eyelets as represented by the spacing of the eyelets 3 in FIG. 1. Thus when the lace-in fastener of the invention is located within a boot having existing eyelets there will be a respective eyelet ring 24 at a position on the lace-in fastener corresponding or substantially corresponding to the position of each existing eyelet of the boot. This would then avoid the problem associated with the prior art of the need to ensure consistent accurate positioning of eyelets 3 on the lace-in fastener means so as to correspond to the eyelets of the boot. The pairs of opposed eyelet rings 5 are preferably disposed as close one to another as possible, by reducing the transverse thickness of either the plastics strip 4 or the backing fabric, to give a high degree of flexibility of fit.

The strips of plastics material may be moulded to any desired or convenient length and, if necessary, cut to size. As stated above, a single line of stitching is sufficient to fix the strips to the sliding clasp fastener and therefore obviate the need for fixing the fastener to the leather panel and for careful positioning of eyelet holes in the leather panel.

I claim:

1. A removable lace-in fastener for an article of foot wear having lace flaps carrying existing spaced lace eyelets said fastener comprising a pair of interengageable cooperating fastening elements each mounted on a longitudinal flexible backing panel having a free outer edge and an inner edge defining a longitudinally extending line along which said elements are movable between open and closed condition, a pair of bendable longitudinally extending strips of plastics material, each one of said pairs having a plurality of integrally moulded eyelet means provided along a first longitudinal outer edge thereof, said eyelet means being more closely spaced at regular intervals than existing eyelets on said article, said strip being attached along a second longitudinal inner edge to said free outer edge of each one of said backing panels, respectively, with said eyelet means extending in a direction away from the inner edges of the respective backing panels such that when said lace-in fastener is located within an article of foot wear having existing eyelets, there will be a respective eyelet means at a position on said lace-in fastener substantially corresponding to the position of each existing eyelet of said article of footwear.

2. A fastener as claimed in claim 1, wherein the fastener means is a sliding clasp fastener.

3. A fastener as claimed in claim 1, wherein the fastener means is a touch and close type fastener.

4. A fastener as claimed in claim 3, wherein the fastener means is a multihook and loop type fastener.

5. A fastener as claimed in claim 1, wherein the second longitudinal edge of each of said pair of strips is serrated or otherwise provided with portions of reduced transverse thickness to increase flexibility of the strip. .

6. A fastener as claimed in claims 1, wherein the eyelet means are substantially semi-annular extensions from the first longitudinal edge of the strip and are spaced regularly along the length of said edge.

7. An item of footwear comprising a removable lace-in fastener as claimed in claim 6.

8. An item of footwear as claimed in claim 7, wherein the item of footwear is a boot having a plurality of conventional eyelets, and the removable lace-in fastener is attached thereto by means of at least one lace passing through the eyelet of the boot and through at least some of said regularly spaced substantially semi-annular extensions.

* * * * *